United States Patent [19]

Kajiwara

[11] 4,369,646

[45] Jan. 25, 1983

[54] ROLLING MILL AND METHOD FOR ROLLING A SHEET MATERIAL

[75] Inventor: Toshiyuki Kajiwara, Hitachi, Japan

[73] Assignee: Hitachi, Ltd., Tokyo, Japan

[21] Appl. No.: 191,911

[22] Filed: Sep. 29, 1980

[30] Foreign Application Priority Data

Oct. 4, 1979 [JP] Japan ..... 54-128732

[51] Int. Cl.[3] ..... B21B 29/00

[52] U.S. Cl. ..... 72/243; 72/247

[58] Field of Search ..... 72/241, 243, 245, 247

[56] References Cited

U.S. PATENT DOCUMENTS 3,818,743 6/1974 Kajiwara et al. ..... 72/243

FOREIGN PATENT DOCUMENTS 53-66849 6/1978 Japan .

54-39349 3/1979 Japan ..... 72/243

*Primary Examiner*—Lowell A. Larson

*Attorney, Agent, or Firm*—Thomas E. Beall, Jr.

[57] ABSTRACT

A rolling mill having a pair of intermediate rolls interposed between a pair of working rolls exerting a working roll bending force and a pair of axially displaced in conformity with the lateral length or width of a rolled material and the intermediate roll bending force larger than the working roll bending force is exerted thereto, and the shape of the sheet is controlled by adjusting the axial position of the intermediate rolls and by exerting the working and intermediate roll bending forces thereto.

18 Claims, 10 Drawing Figures

ROLLING MILL AND METHOD FOR ROLLING A SHEET MATERIAL

BACKGROUND OF THE INVENTION

This invention relates to a rolling mill having a novel roll arrangement and a material shape controlling function and, more particularly, to a rolling mill having working rolls of a small diameter to make an effective rolling operation and effective control of the shape of a rolled material.

Recently, in the field of the rolling production and especially rolling of sheet materials, the improvement in the accuracy of thickness of the rolled sheet material in the longitudinal direction has almost been accomplished and vigorous investigation has further been made to the improvements in the accuracy of thickness of the sheet in the lateral direction and in the shape (flatness) of the sheet and decrease in the rolling power from the requirements for saving of resources and energy. To satisfy such requirements, it is necessary to make a rolling mill having working rolls of a small diameter to provide stable sheet shape and high control performance thereto.

In a quadruple rolling mill which is a typical conventional rolling mill, however, it is difficult to satisfy those requirements in view of its fundamental characteristics. To solve this problem, the inventor found the basic limitations of the quadruple rolling mill (refer to U.S. Pat. No. 3,818,743) and invented a new type of a rolling mill based on a new concept. This type of the rolling mill includes intermediate rolls interposed between backing and working rolls so that the shape control of the rolled sheet material is made by adjusting the axial position of the intermediate rolls in conformity with the lateral length or width of the sheet material and applying the working roll bending action to provide a good shape stability and shape control function and edge drop reducing function, thereby permitting the diameter of the working rolls to be reduced to be equal to 25% of the maximum width of the rolled sheet, although in the conventional quadruple rolling mill practically the diameter of the working rolls is equal to 35–50% of the maximum width of the sheet.

It is further required in the art to realize rolling a still thinner and still harder material, much more saving the energy, much more reducing the edge drop and using a low cost roll coolant. To satisfy these requirements, it must be necessary to decrease the diameter of the working rolls much more. Decrease in such diameter may be accomplished by arranging the rolls in twelve or twenty stages, such as in a known multiple stage rolling mill. As is known in the art, however, such a multiple stage rolling mill is disadvantageous in that a high grade control technique is required in view of its geometry, and the construction, operation and maintenance are complex and difficult and the application is only limited to rolling of specific hard materials, such as stainless steel.

Therefore, such rolling mill is still insufficient to satisfy the above-mentioned requirements. In such rolling mill, the bending moment is produced on the working roll itself by adjusting the axial position of the intermediate rolls and bending the working rolls, but when the rigidity of the shafts of the working rolls is lowered the working rolls interposed between the sheet material and the intermediate rolls are locally deflected to form a composite crown or quarter buckling between the center portion of the sheet material and side portions thereof. To prevent the formation of such composite crown, the working rolls should have a suitable rigidity against the deflection for the width of the sheet. According to the investigation made by the inventor, it was proved that in case of the working rolls being made of steel the roll diameter should be more than 20% of the width of the sheet when not using the working roll bending, and it was preferable that the roll diameter should be about 10–15% larger than it when using the working roll bending. Namely, the diameter of the working rolls should be 22–23% of the width of the sheet and has to be more than 25% of the latter in consideration of the grinding allowance.

To solve such problems, on the other hand, the inventor has already proposed a rolling mill utilizing an intermediate roll bending system (refer to Japanese Patent Laid Open To Public No. 66849/1978). The idea of this rolling mill is based on the consideration that when using working rolls of a small diameter the small rigidity of their shafts increase the tendency to follow the profile of the rolls supporting it, therefore there is proposed bending the intermediate rolls having an appropriate rigidity to make the shape control. However, such rolling mill has drawbacks, since the working roll is in contact with the whole length of the intermediate roll, the portion of the intermediate roll that is in contact with the working roll and larger than the width of the sheet acts to strongly bend the working roll, thereby causing an extreme reduction of the sheet thickness at its side edge portion.

SUMMARY OF THE INVENTION

Therefore, it is an object of the present invention to provide a rolling mill having working rolls of a small diameter and a simple roll construction to effectively produce rolled products and make a good shape control.

Another object of the present invention is to provide a rolling mill capable of attaining the rolling of a thinner and harder material, increased energy saving and large decrease in the edge drop.

A further object of the present invention is to provide a rolling mill in which the rolling load is extremely reduced and a small diameter of backing rolls can be provided to extremely reduce the manufacturing cost of the mill itself.

A still further object of the present invention is to provide a rolling mill having working rolls of a small diameter to minimize the composite crown and control the sheet crown of the rolled material.

Another object of the present invention is to provide a rolling mill having a mechanism for always applying a stable and positive roll bending force to the axially movable intermediate rolls.

A further object of the present invention is to provide a rolling mill in which thrust loads acting on small diameter working rolls are effectively supported to solve the problems of the strength and life of such working rolls.

A still further object of the present invention is to provide a method for rolling a material in which the intermediate roll bending function and the working roll bending function are utilized to provide a very good shape throughout the width of the rolled material and control the sheet crown.

According to the present invention, there is provided a rolling mill comprising a pair of working rolls brought into contact with a material to be rolled, a pair of intermediate rolls positioned vertically outwardly of the respective working rolls to contact therewith, a pair of backing rolls for supporting the respective intermediate rolls, means for displacing the intermediate rolls to position the end portions of the roll barrel thereof adjacent to lateral ends of the rolled material and means for applying a roll bending to the working rolls to control the shape of the rolled material, wherein there is further provided means for applying to the intermediate rolls a bending force larger than the bending force acting to the working rolls so that the shape of the rolled material is controlled by adjusting the axial position of the intermediate rolls and applying the working roll bending action and the intermediate roll bending action.

DETAILED DESCRIPTION OF THE PREFERRED EMBODIMENT

An embodiment of the present invention will be described with reference to the accompanying drawings.

Figure 1:
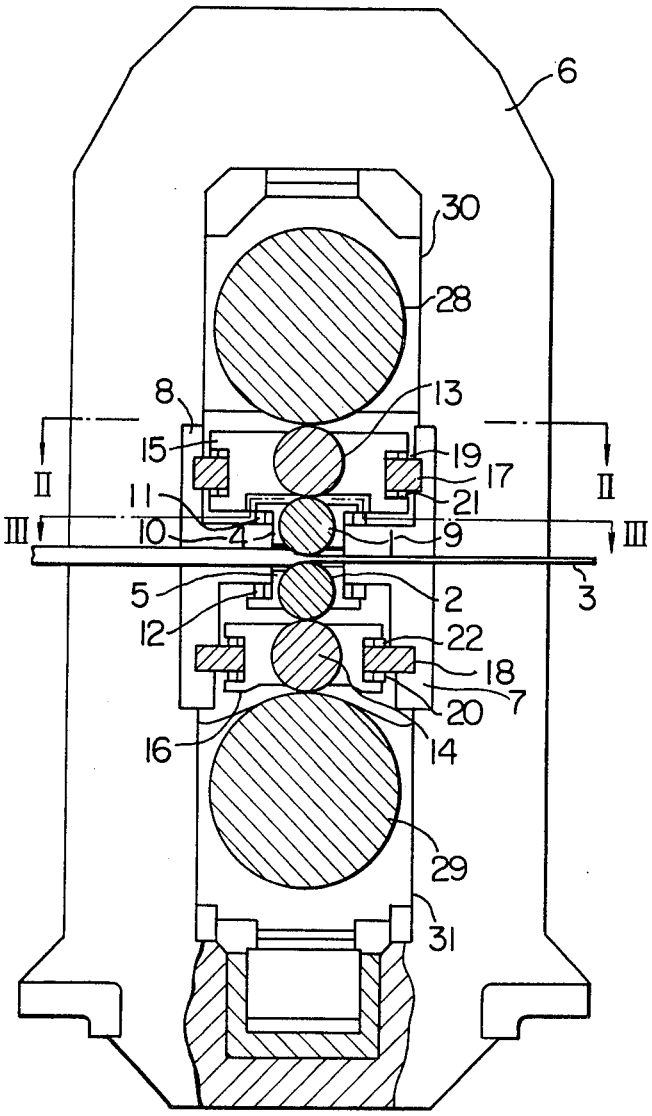
FIG. 1 is a front view of an embodiment of a rolling mill of the present invention.
Figure 2:
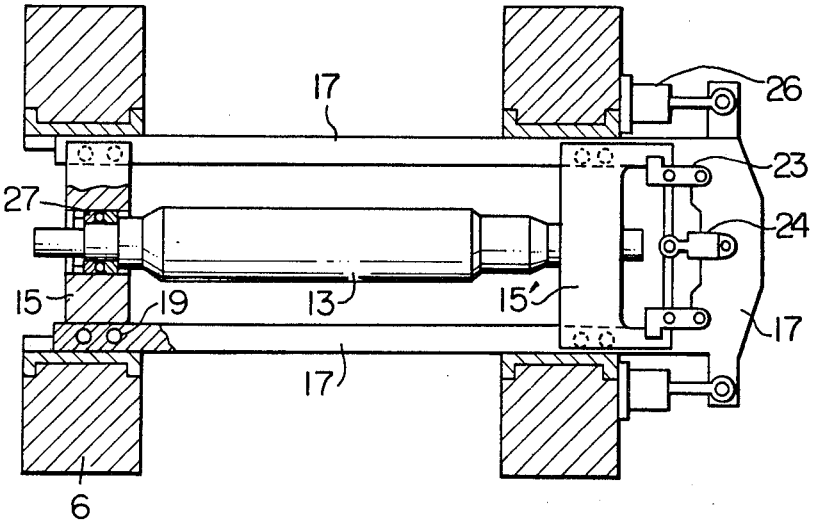
FIG. 2 is a view taken along a line II—II of FIG. 1.
Figure 3:
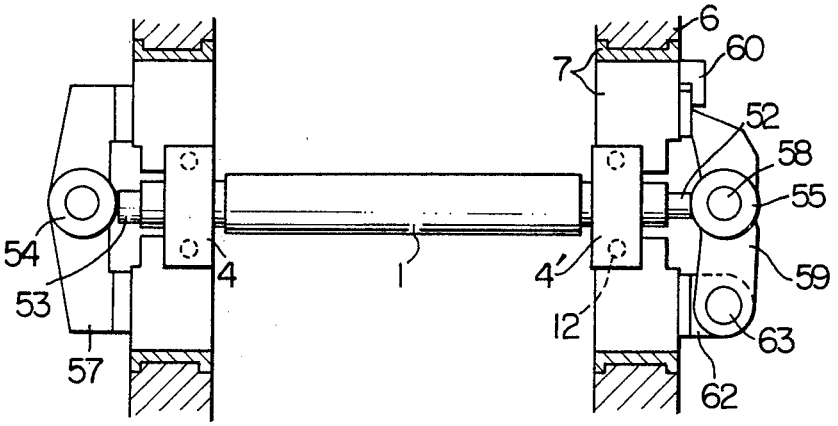
FIGS. 3–6 show an arrangement for supporting working rolls of the rolling mill and FIG. 3 is a view taken along a line III—III of FIG. 1, FIG. 4 being a partly fragmentary view of a metal chock portion, FIG. 5 being a front view thereof and FIG. 6 being a schematic side view of a roll end portion.
Figure 4:
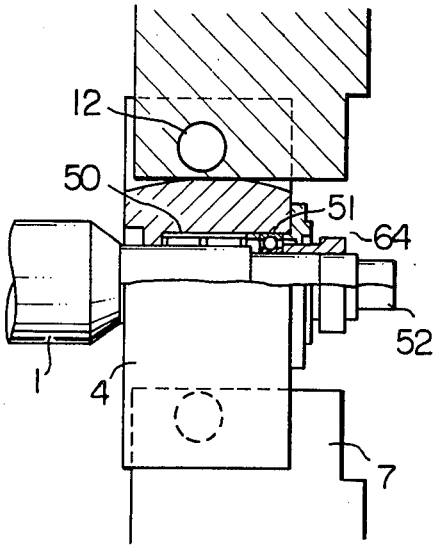

FIG. 1 shows an embodiment of the present invention and FIG. 2 is a view taken along an arrow II—II of FIG. 1 showing a mechanism for displacing an intermediate roll. There is provided a pair of working rolls 1 and 2 having a small diameter for rolling a material to be rolled, the working rolls being supported at their ends by metal chocks 4, 5. Each of the metal chocks 4, 5 is disposed for upward and downward movements inside of projections 9, 10 of projecting blocks 7, 8 provided in a window of a roll housing 6 and these projections are provided therein with hydraulic rams 11, 12 for bending the working rolls.

There is also provided a pair of intermediate rolls 13 and 14 which are disposed on the upper and lower sides of the working rolls 1 and 2, respectively, and ends of the intermediate rolls are supported by metal chocks 15, 16. Each of the metal chocks 15, 16 is disposed for upward and downward movements inside of movable blocks 17, 18 which are axially movably mounted on the projecting blocks 7, 8, and the movable blocks 17, 18 are respectively provided therein with hydraulic rams 19, 20 for applying an increased bending to the intermediate rolls and with hydraulic rams 21, 22 for applying a decreased bending thereto. The movable block 17 has attached thereto a cylinder 24 for pivotally moving a keeper plate 23 having a convex portion, while a driving metal chock 15' for the intermediate roll is provided with a concave portion engaging the convex portion. With such arrangement, if the movable block 17 and the driving metal chock 15' are connected to each other through the keeper plate 23, the intermediate roll together with the movable block will be able to be axially moved under the action of the cylinder 26. In this case, the intermediate roll chocks and the hydraulic rams 19, 20, 21, 22 are moved together and thus the bending forces can always be applied to the center of intermediate roll bearings 27 by locating the rams in position. Moreover, the intermediate rolls are larger in diameter than the working rolls and the bending forces on the intermediate rolls are larger than those on the working rolls.

There are further provided backing rolls 28 and 29 for supporting the intermediate rolls 13, 14, respectively, the backing rolls being larger in diameter and higher in rigidity than those of the intermediate rolls. Metal chocks 30, 31 for the backing rolls are vertically movable provided in the roll housing.

With the arrangement described above, when replacing the intermediate rolls, the keeper plate 23 is released by the hydraulic cylinder 24 to permit the removal of only the roll assembly, while the movable block 17 remains in the roll housing 6. In this embodiment, the hydraulic rams 11, 12 for bending the working rolls are shown for increasing the bending force, but rams for decreasing the bending force may be also provided. However, the latter will practically not be necessary and are not shown, because such function can be accomplished by operating the rams for decreasing the bending force to the intermediate rolls and outwardly shifting the ends of the intermediate rolls. Furthermore, the decreased bending of the intermediate rolls is effective to control the compensation for the thermal crown of the rolls. The main effects of the increased bendings of the working and intermediate rolls will be described in detail hereinbelow.

When it is intended to practically use the rolling mill of the present invention, the problems of the structural strength should be considered in order to adopt a sufficiently small diameter of working rolls. In the rolling mill of the invention, driving of the working rolls is not permitted in view of the structural strength, and it is, therefore, desirable to adopt an intermediate or backing roll driving system. In such case, it is necessary to consider the effects resulting from the tangential forces acting on the working rolls, such as the effects of the bending strength and horizontal deflection of the barrels and necks of the working rolls on the shape of the rolled sheet and the life against the horizontal forces on the roll neck bearings, the bending and thrust forces. FIGS. 3–6 show an example of the working roll supporting construction in which such problems are considered. In this example, moreover, the metal chocks of the working rolls are directly supported by the roll housing 6.

The working roll 1 is supported at its opposite ends by metal chocks 4, 4' which are, in turn, supported by needle bearings 50 and maintained by thrust bearings 51 against axial movement. The thrust force acting on the working roll 1 is not transmitted to the metal chocks, and end portions 52, 53 thereof are directly supported by thrust rollers 54, 55, 56, so that the thrust bearings 51 are only loaded by a small force. The thrust roller 54 is provided on the roll housing 6 by way of a lever 57. The thrust rollers 55, 56 are pivotally mounted on pin 58 which, in turn is, supported by a lever 59 to follow upward and downward movements of the working roll 1. Each of the thrust rollers contains an anti-friction bearing for rotation about an axis deviated at 90° by the rotation of the working roll 1. When replacing the rolls, a keeper plate 60 attached to the roll housing 6 is released to allow the lever 59 supporting the thrust rollers to rotate about a pin 63 provided on a supporting table 62 to open the passage for the working rolls. There is further shown a stop nut 64 in the drawing. With the arrangement, the radial load caused by the horizontal force and the bending force is supported by the needle bearing 50 and the thrust force is directly supported by the thrust rollers 54, 55, 56 on the working rolls so that even when the diameter of the working rolls is fairly small the problems mentioned above will not be raised.

Figure 7:
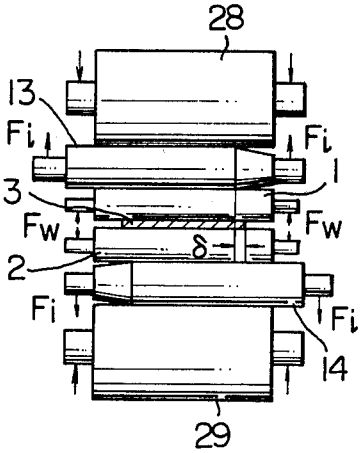
FIG. 7 is a schematic side view of the rolling mill of the present invention for explaining the meanings of the various reference characters.
Figure 5:
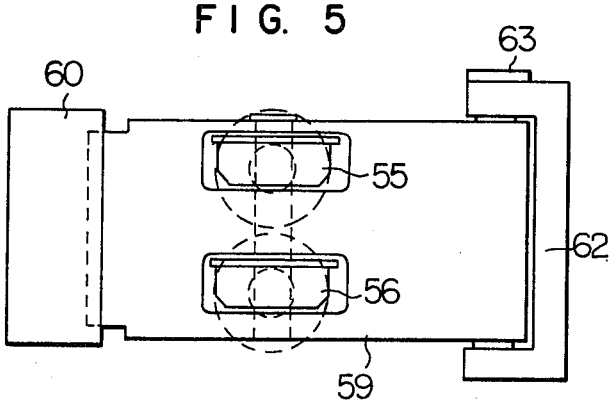
Figure 6:
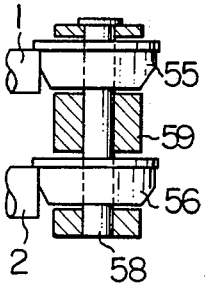

FIG. 7 is a schematic side elevation of the rolling mill to show some relation of the components by various reference characters. In the drawing, $F_i$ is an intermediate roll bending force and $F_w$ is a working roll bending force. The end portions of the roll barrel of the intermediate roll are positioned on or near the vertical end surface of the sheet to be rolled, and this condition is shown by a character δ. Practically, this character shows an axial distance between the end portion of the intermediate roll and the end of the rolled material 3. In case of an intermediate roll having a stepped end portion, the stepped portion of the roll end is registered with the end portion of the rolled material 3. In general, the end portions of the intermediate rolls are formed in a converging configuration to reduce the stress concentration in their stepped end portions and prevent the rolls from being damaged, but the converging ends are out of contact with adjacent working and backing rolls so that the converging outermost ends do not substantially contribute to the rolling operation. Therefore, it will be understood that the position of the end portions of the roll barrel of the intermediate roll for determining the value δ in case of the roll having converging ends should be on or near the boundary between the contact end non-contact areas thereof with the adjacent rolls and practically on or near the base portions of the converging ends. In other words, the converging outermost end portions should be excluded from the position for determining the value δ.

Figure 8:
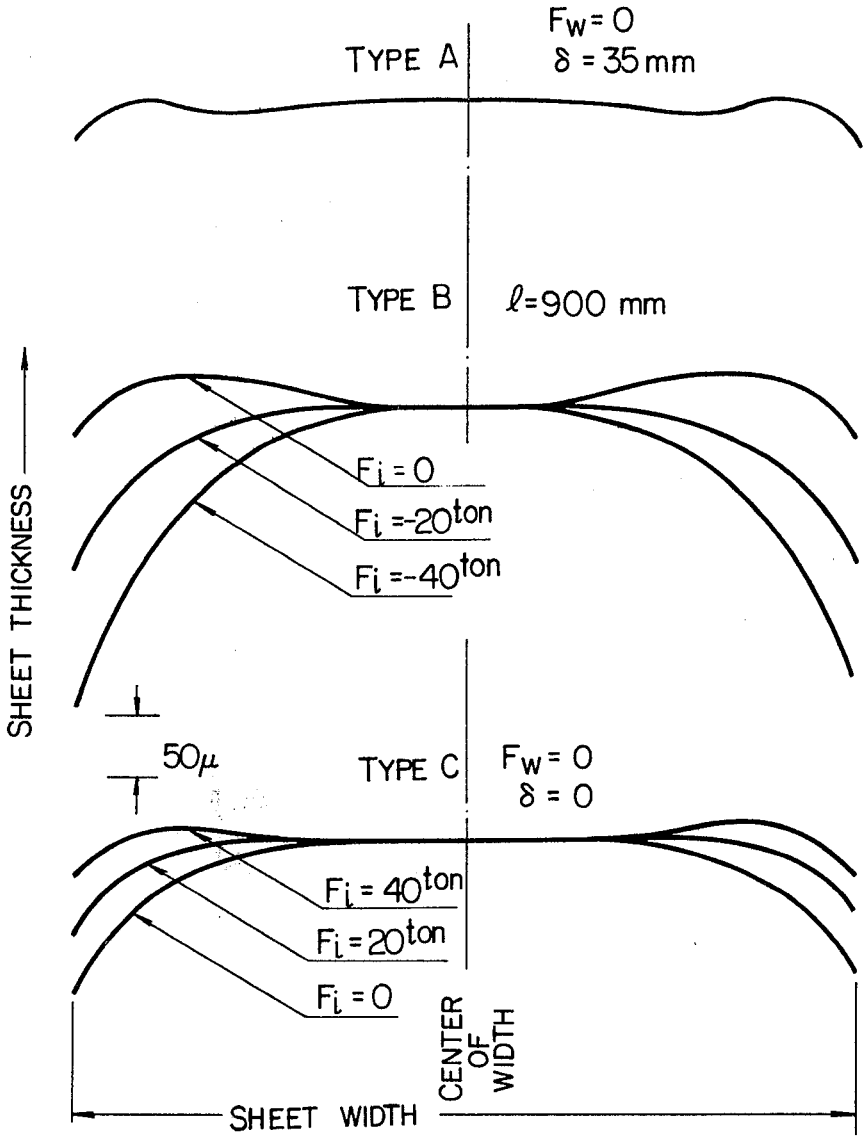
FIGS. 8–10 are graphs showing various shape control characteristics.

The shape control characteristics of the rolling mill according to the present invention will be described with reference to FIG. 8 in comparison with known rolling mills.

In the drawing, the shape control characteristics referred to as type A are of a known rolling mill in which the axial movement of the intermediate rolls and the bending of the working rolls are provided, the characteristics referred to as type B being of a known rolling mill of the above-described intermediate roll bending system and the characteristics referred to as type C being of the rolling mill of the present invention in which the axial movement of the intermediate rolls and the bending of the intermediate and working rolls are provided (provided that the bending force of the intermediate rolls is larger than that of the working rolls.) If the diameter of the working roll is theoretically more than 20% of the width of the sheet 3 and practically more than 25% of the width of the sheet 3, the drawbacks of the type A will not take place, and thus there will be described the result theoretically calculated in respect of a rolling mill including working rolls having a diameter of 210 mm equal to 17.5% of 1200 mm of the maximum sheet width. The diameter of the intermediate rolls is 420 mm, the diameter of the backing rolls being 1350 mm and the length of the roll barrel being 1420 mm, but in the type B the effective barrel length l of the backing rolls being 900 mm and thus resulting from the fact that in case of the maximum width of the sheet being 1200 mm the minimum width is within the range of 600–750 mm and the shape control becomes difficult as the width becomes small. The result of the calculation shows the fact that in case of the effective barrel length being 900 mm the shape control is insufficient when the width is less than 750 mm, but the shape control is possible when the width is within the range of 750–1200 mm. FIG. 8 shows a distribution of the sheet thickness in the laterial direction when cold rolling was made to a width of 1200 mm under the above-described conditions.

In type A, it is necessary to locate the end portions of the intermediate rolls inside of the adjacent ends of the sheet material and in this case the value δ is 35 mm. In this event, a slightly convex crown is caused on the center portion of the width of the sheet material and concave crowns are caused at one quarter and three quarters of the sheet width and thus a composite crown is caused as a whole. This is called a secondary elongation or pocket in the sheet shape which is difficult to treat practically. The cause of it is that the positioning of the end portions of the intermediate rolls inside of the sheet ends provides no support against the counter forces derived from the rolled material and thus a large bending moment acts on the working rolls not to provide a bending rigidity necessary to continuously transmit the axial deflection of the working rolls throughout their length. If the amount of the inward shift is decreased and the compensation therefor is made by the working roll bending, a fairly large composite crown will be caused.

In the type B, it will be found that the effect of the intermediate roll bending is sufficiently brought forth to allow the control of the crown in a wide range from the concave crown to the convex crown. Such a composite crown as caused in the type A using the small diameter of the rolls is not formed, but a large reduction in the thickness at the ends of the sheet is caused and A does not satisfy the requirements to control the shape of the sheet well and to obtain a uniform rectangular form in section.

In the type C, there is shown the fact that the rate of the displacement of the intermediate roll is smaller than that in the type A and by calculation the end portion of the intermediate roll is registered with the end of the sheet and the deflection of the working roll is altered by the intermediate roll bender to prevent the reduction in the thickness at the ends of the sheet as caused in the type B. This difference results from the fact that although it has been already described in the type B the working roll is bent by the spring action caused by the roll-flattening due to contact of it with the roll barrel outside of the width of the sheet, whereas in the type C such action is minimized by the effect of the displacement of the intermediate roll.

Figure 9:
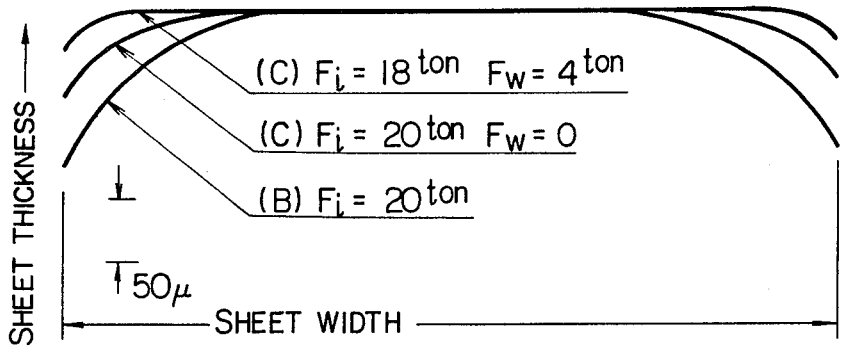
Figure 10:
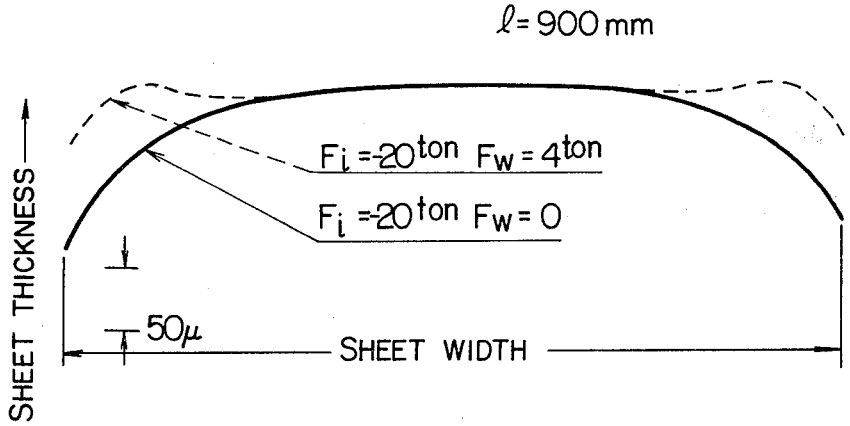

FIG. 9 shows a comparison of the conditions in which the sheet crown is minimized within the range of no occurrence of the composite crown in the types B and C. The type C has a smaller crown than that of the type B. Furthermore, when the working roll bender is applied in the type C, the crown is further improved, but when the working roll bending force increases over a certain extent, the shape control should not be made throughout the width of the sheet, but should be made locally and overall control should be made by the intermediate roll bending. Thus, even if the installation capacity of the work roll bender were increased over the installation capacity of the intermediate roll bender, it would be necessary to reduce the output of the work roll bender below the output of the intermediate roll bender. In this case, the working roll bending extremely acutely affects to vary the shape of the sheet ends and thus it is necessary to make a fine control and increase the capacity largely. In contrast, the intermediate roll bending requires an overall control and a large capacity of bending device because of the high bending ridigity of the rolls in general. If the working roll bender is similarly applied in the type B, an excess contact with the intermediate rolls causes a composite crown as shown in FIG. 10 not to be brought into practice.

In this manner, the type C rolling mill according to the present invention brings forth the effects that a small diameter of the working rolls can be used to provide a good shape of the rolled sheet material throughout its width and good crown control thereby accomplishing an efficient rolling operation and largely reducing the rolling load to reduce the diameter of the backing rolls and thus the manufacturing cost of the rolling mill. Such effects may also be brought forth by the type B rolling mill, if the intermediate rolls are changed by different ones having a suitable effective barrel length as the width of the sheet varies, but there are drawbacks of difficulty in choice of the suitable effective barrel length, low productivity due to increase in the time of roll change and lack of control function by changing the effective length in respect of the same width of the sheet, and it is apparent that the type C is superior to the type B.

Furthermore, the type A requires to position the end portion of the intermediate roll inside of the sheet end in order to utilize the merit that no crown is provided on the rolls. This is disadvantageous in case that it is not desirable to form an uneven brilliance on the surface of a rolled material, such as a rolled aluminum sheet. On the contrary, the method of the present invention can ordinarily position the end portion of the intermediate roll outside of the sheet end by the action of the intermediate roll bending. Moreover, in the type A, if the end portion of the intermediate roll is positioned inside of the sheet end, there is a point of infinite width rigidity at which no deflection is equivalently caused on the working roll by the rolling load, but the small diameter of the working roll subject to the present invention has no such function, because the end of the intermediate roll is generally positioned adjacent to the end of the sheet. It is, therefore, necessary to control the intermediate roll bending force in conformity with the rolling load. Since this necessary bending force has a different proportional constant to the rolling load depending upon the sheet width, as the sheet width is a known factor, the intermediate roll bending force can be controlled in proportion to the rolling load.

It will further be understood from FIG. 9 that the working roll bending force mainly affects the end portion of the sheet and it can not be said that the working roll bending forces does not affect the center portion of the sheet. In order to prevent the center portion from being affected by the working roll bending force, it is preferable to control the intermediate roll bending in interlocking relation to the control of the working roll bending.

I claim:

1. A rolling mill comprising:

a pair of work rolls of low rigidity performing rolling of a material to be rolled by contact therewith;

a pair of intermediate rolls positioned vertically outwardly of the respective work rolls in contact therewith, said pair of intermediate rolls each having a diameter greater than that of said work rolls;

a pair of back-up rolls supporting the respective intermediate rolls;

means for axially displacing each of said intermediate rolls to position the end portion of the roll barrel thereof on or near a vertical lateral end surface of the rolled material to compensate for a deflection caused by a rolling force at one portion of a respective one of said work rolls; and means for applying to each of the intermediate rolls a bending force to compensate for a deflection caused by the rolling force at the other portion of the respective one of said work rolls so that the shape of the rolled material can be controlled by the combination of adjustments of the axial position of the intermediate rolls and application of an intermediate roll bending action.

2. The rolling mill as claimed in claim 1, further comprising means for applying to the work rolls a bending force to compensate for a deflection caused by a rolling condition at the end portions of each said work roll so that the shape of the rolled material can be controlled by the combination of adjustments of the axial position of the intermediate rolls and application of the intermediate roll bending action and work roll bending action.

3. The rolling mill as claimed in claim 2, wherein said means for applying to the intermediate rolls a bending force is such that the bending force applied to the intermediate rolls is greater than that applied to the work rolls.

4. The rolling mill of claim 1, wherein said means for axially displacing said intermediate rolls include metal chocks supporting said intermediate rolls and a mounting for said metal chocks providing axial movement of said metal chocks, and said applying means includes hydraulic rams for applying the roll bending force through said metal chocks to said intermediate rolls.

5. The rolling mill of claim 4, further including a fixed roll housing at each end of said rolls for the rolled material to pass therebetween; each of said means for axially displacing including blocks, each extending between said housing and being mounted on said housing for relative axial movement, bearing means mounting said chocks for vertical relative movement on said blocks and said rams extending between said blocks and chocks.

6. The rolling mill of claim 4 or claim 5, wherein separate ones of said hydraulic rams are provided respectively for increasing and decreasing the bending of the intermediate roll.

7. The rolling mill of claim 4, including metal chocks supporting said working rolls, respectively, and having therein radial bearings and separate thrust bearings.

8. The rolling mill of claim 4, including metal chocks supporting said working roll, respectively, means for mounting said chocks on the roll housing for relative vertical movement therebetween, and hydraulic rams extending between said housing and said chocks for increasing the bending of said working roll.

9. A rolling mill comprising:

a pair of work rolls of low rigidity performing rolling of a material to be rolled by contact therewith, said work rolls having a diameter smaller than 25% of the minimum sheet width of the rolled material;

a pair of intermediate rolls positioned vertically outwardly of the respective work rolls in contact therewith, said intermediate rolls having a diameter larger than that of said work rolls;

a pair of back-up rolls supporting the respective intermediate rolls;

means for axially displacing the intermediate rolls to position the end portions of the roll barrel thereof on or near vertical lateral end surfaces of the rolled material, so that one of the end portions of each said work roll is rendered free from contact pressure applied by the respective intermediate rolls associated therewith; and means for applying a roll bending force to said intermediate rolls and said work rolls so that the shape of the rolled material across the width thereof can be controlled by the combination of adjustments of the axial position of the intermediate rolls and application of an intermediate roll bending action controlled in interlocking relation to the control of a work roll bending action.

10. The rolling mill of claim 9, wherein said means for axially displacing said intermediate rolls include metal chocks supporting said intermediate rolls and a mounting for said metal chocks providing axial movement of said metal chocks, and said applying means includes hydraulic rams for applying the roll bending force through said metal chocks to said intermediate rolls.

11. The rolling mill of claim 10, further including a fixed roll housing at each end of said rolls for the rolled material to pass therebetween; each of said means for axially displacing including blocks, each extending between said housing and being mounted on said housing for relative axial movement, bearing means mounting said chocks for vetical relative movement on said blocks and said rams extending between said blocks and chocks.

12. The rolling mill of claim 10 or claim 11, wherein separate ones of said hydraulic rams are provided respectively for increasing and decreasing the bending of the intermediate roll.

13. The rolling mill of claim 10, including metal chocks supporting said working rolls, respectively, and having therein radial bearings and separate thrust bearings.

14. The rolling mill of claim 10, including metal chocks supporting said working roll, respectively, means for mounting said chocks on the roll housing for relative vertical movement therebetween, and hydraulic rams extending between said housing and said chocks for increasing the bending of said working roll.

15. A method of rolling a sheet material to be rolled by a rolling mill, comprising the steps of:

bringing a pair of working rolls into contact with the material;

positioning a pair of intermediate rolls vertically outwardly of the respective working rolls to contact therewith;

positioning a pair of backing rolls for supporting the respective intermediate rolls;

axially displacing the intermediate rolls to position one of the end portions of the roll barrels thereof on or near vertical lateral end surfaces of the rolled material;

applying a roll bending to said working rolls to control the shape of the rolled material;

applying to the intermediate rolls a bending force larger than the bending force to said working rolls; and controlling the axial movement of the intermediate rolls, work roll bending action and intermediate roll bending action in combination in such a manner that control of the shape or crown of the rolled material across the width thereof is mainly effected by the intermediate roll bending and control of the edge portions of the rolled material is mainly effected by work roll bending.

16. A rolling mill, comprising:

a roll housing;

a pair of working rolls vertically spaced from each other and rotatably supported within said housing for movement towards and away from each other for rolling material therebetween;

a pair of intermediate rolls contacting respective ones of said work rolls radially outward thereof;

back-up rolls means vertically outward of said intermediate rolls and supporting said intermediate rolls, and being mounted on said roll housing;

separate means for mounting each of said intermediate rolls, each including a pair of blocks horizontally spaced outwardly from the respective intermediate roll and extending axially the full length of said intermediate roll, cross slide bearing means mounting said blocks for horizontal movement parallel to the roll axes and vertical movement perpendicular to the roll axes, a pair of metal chocks with bearings supporting respectively the opposite ends of the intermediate roll, each of said metal chocks extending between said pair of blocks and being supported thereby, axial displacement means for axially moving said blocks simultaneously relative to said roll housing and thereby correspondingly moving said chocks and intermediate roll, hydraulic ram means extending between each of said chocks and each of said blocks for applying bending moments to said intermediate roll.

17. The rolling mill of claim 16, wherein said hydraulic rams are immediately radially adjacent the associated bearings and substantially in the same plane for each end of the intermediate roll, which plane is perpendicular to the roll axis.

18. The rolling mill of claim 16, wherein said cross slide bearing means for each end of said intermediate roll is within the respective one of said planes.

* * * * *